US011033950B2

(12) United States Patent
Nillies

(10) Patent No.: US 11,033,950 B2
(45) Date of Patent: Jun. 15, 2021

(54) METHOD FOR PRODUCING A GAS OR LIQUID TANK

(71) Applicant: Leifeld Metal Spinning AG, Ahlen (DE)

(72) Inventor: Benedikt Nillies, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 203 days.

(21) Appl. No.: 16/081,897

(22) PCT Filed: Nov. 28, 2016

(86) PCT No.: PCT/EP2016/078933
§ 371 (c)(1),
(2) Date: Aug. 31, 2018

(87) PCT Pub. No.: WO2017/148551
PCT Pub. Date: Sep. 8, 2017

(65) Prior Publication Data

US 2019/0022735 A1 Jan. 24, 2019

(30) Foreign Application Priority Data

Mar. 4, 2016 (DE) ..... 10 2016 103 946

(51) Int. Cl.
*B21H 1/18* (2006.01)
*B21H 5/02* (2006.01)
*B21H 1/06* (2006.01)

(52) U.S. Cl.
CPC ..... *B21H 1/18* (2013.01); *B21H 5/025* (2013.01); *B21H 1/06* (2013.01)

(58) Field of Classification Search
CPC ... B21H 1/06; B21H 1/18; B21H 5/02; B21H 5/025; B21B 35/00; B21B 35/02; B21B 35/04

(Continued)

(56) References Cited

U.S. PATENT DOCUMENTS 3,029,667 A * 4/1962 Sporck ..... B21D 22/16 72/105
3,160,036 A * 12/1964 Ernestus ..... B21D 22/16 72/85

(Continued)

FOREIGN PATENT DOCUMENTS

CH 432 436 A 3/1967
DE 1 602 264 A1 5/1970

(Continued)

OTHER PUBLICATIONS

International Preliminary Report on Patentability issued in PCT/EP2016/078933; Date of Completion Jun. 29, 2018; with English translation.

(Continued)

*Primary Examiner* — Adam J Eiseman
*Assistant Examiner* — Bobby Yeonjin Kim
(74) *Attorney, Agent, or Firm* — Studebaker & Brackett PC

(57) ABSTRACT

The invention relates to a method for shaping a workpiece having a drum-type peripheral wall, on the inner face of which an inner profile featuring longitudinal ribs is formed by feeding at least one profiling roll to said inner face. According to the invention, at least one rotatably mounted profiling roll is fed to an inner face of the peripheral wall of the workpiece, and said at least one profiling roll rotates relative to the inner face of the peripheral wall such that the inner profile is formed in the inner face in a non-cutting manner.

8 Claims, 2 Drawing Sheets

Figure 1:
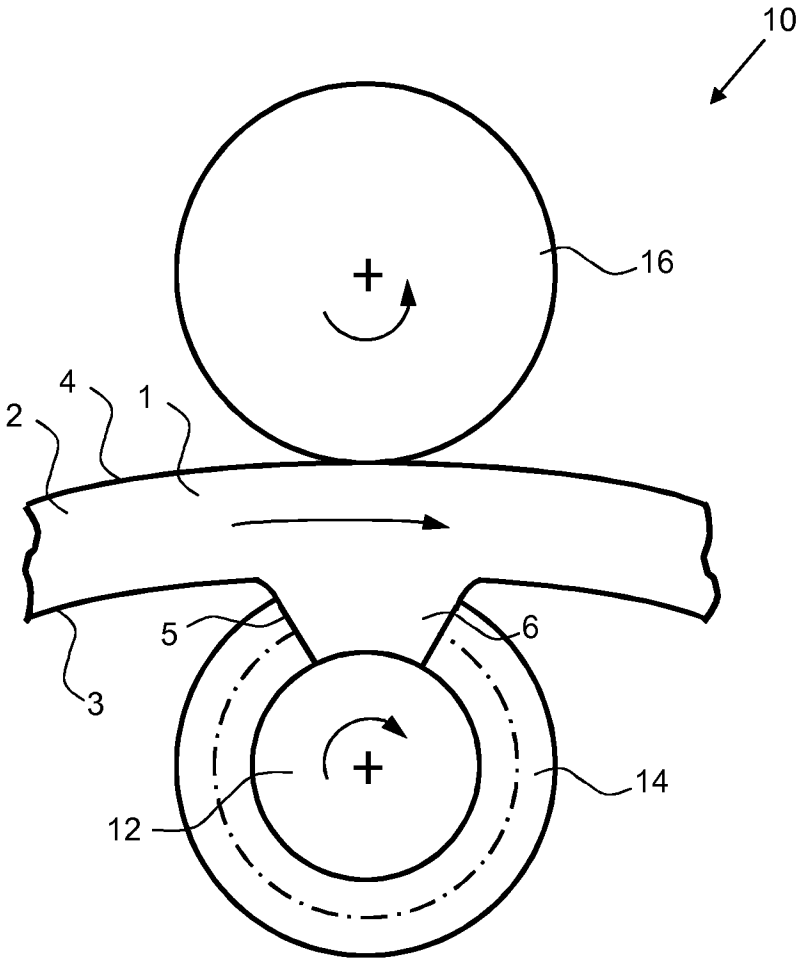

(58) Field of Classification Search
USPC ..... 72/105, 108, 109, 111, 120, 121
See application file for complete search history.

(56) References Cited

U.S. PATENT DOCUMENTS

| | | | | | |
|---|---|---|---|---|---|
| 3,469,427 | A | * | 9/1969 | Rollins | B21H 1/12 72/91 |
| 4,126,029 | A | * | 11/1978 | Mathur | B21H 1/06 72/69 |
| 4,538,439 | A | * | 9/1985 | Frei | B21D 15/04 220/670 |
| 4,766,752 | A | * | 8/1988 | Gronert | B21B 19/14 72/110 |
| 5,261,261 | A | * | 11/1993 | Ramsey | B21D 22/105 72/105 |
| 5,622,070 | A | * | 4/1997 | Bulso, Jr. | B21D 51/2646 72/105 |

FOREIGN PATENT DOCUMENTS

| | | | |
|---|---|---|---|
| DE | 1 552 178 | A1 | 9/1970 |
| DE | 24 20 014 | A1 | 1/1975 |
| DE | 44 08 427 | A1 | 10/1995 |
| DE | 10 2004 010 444 | A1 | 9/2005 |
| DE | 10 2006 032 304 | A1 | 1/2008 |
| DE | 10 2006 038 379 | A1 | 4/2008 |
| EP | 1 621 269 | A1 | 2/2006 |
| EP | 2 210 682 | A1 | 7/2010 |
| JP | 2010-017737 | A | 1/2010 |
| JP | 2010-125520 | A | 6/2010 |
| WO | 2008/139323 | A2 | 11/2008 |

OTHER PUBLICATIONS

International Search Report issued in PCT/EP2016/078933; dated Mar. 22, 2017.

* cited by examiner

METHOD FOR PRODUCING A GAS OR LIQUID TANK

The invention relates to a method for producing a gas or liquid tank with a drum-shaped circumferential wall, on the internal side of which an internal profile with longitudinal ribs is formed by feeding at least one profiling roller.

Methods of such type for producing pressure tanks can be taken from DE 10 2006 032 304 A1 or DE 10 2006 038 379 A1 for example. A pipe-shaped basic workpiece is arranged on a mandrel with rectilinear milled-out portions. Through flow forming the basic workpiece is pressed against the mandrel and in doing so longitudinal ribs are formed according to the milled-out portions.

DE 1 602 264 A describes a method for producing longitudinally ribbed pipes. In this known method a pipe-shaped basic workpiece is slid onto a mandrel that is provided with teeth on its external side. By feeding spinning wheels with teeth the thin-walled pipe is formed into the toothing on the inner mandrel. Hence, in this known method the entire pipe wall is formed so that the profile is designed both on the internal side and on the external side of the workpiece.

From DE 24 20 014 A1 a stretch-flow forming method can be taken, in which a basic workpiece is also placed onto a profiled mandrel. Through stretch-flow forming implemented by means of stretch-flow forming rollers the workpiece is extended and the material is formed into the profiling on the inner mandrel. This known method for forming an internal profile necessitates an unavoidable forming of the external contour of the workpiece.

Further methods for forming a pipe-shaped workpiece by making use of a profiled inner mandrel can be taken from EP 2 210 682 A1 or CH 432436 A.

From DE 1 552 178 A a method for the roll reduction of annular wall thicknesses is known. Wheel-shaped rolls are fed simultaneously to the internal and external side of a pipe-shaped workpiece. Through this, a reduction of the wall thickness along with a simultaneous extension of the workpiece can be produced. Furthermore, this printed publication teaches that the reducing rolls be separated from each other at certain intervals so that circumferential annular ribs can be designed.

From DE 10 2004 010 444 A1, WO 2008/13932312 A2 and EP 1621 263 A1 methods for producing gear parts with an internal toothing can be taken. DE 44 08 427 A1 relates to the production of a ring-shaped torsional vibration balancer.

The invention is based on the object to provide an efficient method for producing a gas or liquid tank.

The method according to the invention is characterized, among other things, in that at least one rotatably supported profiling roller is fed to an internal side of the circumferential wall and that the at least one profiling roller circulates relative to the internal side of the circumferential wall, wherein the internal profile is formed in a non-cutting manner.

A basic idea of the invention resides in the fact that an internal profile with longitudinal ribs is formed from the inside into an internal side of a cavity wall by means of a profiling roller. The internal profile is formed through rolling or roll forming, as it were. According to the invention the external circumference of the profiling roller is matched to the internal diameter of the workpiece so that upon multiple circulation of the circumferential wall of the rotating workpiece with respect to the profiling roller a precise meshing of the external profile on the profiling roller with the internal profile formed on the internal side of the circumferential wall is given.

With the method according to the invention it is possible to provide even larger workpieces of a larger internal diameter with an internal profile, for which the production of an inner mandrel with a matching counter-profile is not economically viable. Moreover, when changing the internal profile the profiling roller alone needs changing and not a complex inner mandrel. By preference, the workpiece is set into rotation via a main spindle drive. Alternatively, the workpiece can be stationary while the internally disposed profiling rollers are driven in a rotating manner.

According to the invention a preferred method variant resides in the fact that the at least one profiling roller is fed axially and/or radially. The roller can be rotatably supported on a roller support, by preference being rotatably driven via a roller drive. The profiling roller is fed with a corresponding feed force so that the material of the workpiece is deformed in a non-cutting manner and the desired internal profile with the axial longitudinal ribs is formed. In this, the workpiece rotation and the roller rotation are synchronized, by preference being coordinated in a slip-free manner. However, when the profiling rollers are driven by a separate roller drive a defined slip may be provided for a meshing of the external profile of the profiling roller with the internal profile so that the profiles intermesh precisely. Depending on the feed movement and the workpiece clamping an extension of the workpiece may be effected. Alternatively, the length of the workpiece may remain the same while the displaced material is exclusively used to constitute the profiling.

According to a further embodiment variant of the method pursuant to the invention it is preferred that at least two profiling rollers are fed, the positions and feed movements of which are coordinated so that a uniform internal profile is formed on the internal side. Preferably, three, four or more profiling rollers are provided such that they are evenly distributed along the internal circumference of the workpiece. The workpiece can have a diameter of up to 1 m and more. Position, diameters and feed movements of the profiling rollers are coordinated in a synchronized manner such that the profiles of roller and workpiece always intermesh. In this way, a precise, uniform internal profile can be produced on the internal side of the workpiece.

Basically, it is possible to also carry out forming operations on the external side of the workpiece, especially to effect a profiling of the external side as well. An advantageous embodiment of the method according to the invention resides in the fact that a profiling is exclusively carried out on the internal side of the circumferential wall. A preprocessed external diameter of the workpiece can thus remain unchanged.

Especially in the case of relatively thin-walled workpieces it is advantageous according to a further method variant that to each internal profiling roller an external counter-pressure roller is assigned which is fed radially opposite the profiling roller to an external side of the workpiece. By preference, the external counter-pressure roller is smooth-surfaced, whereby an undesired deformation of the external side of the workpiece is counteracted. The counter-pressure roller serves as a counter bearing to absorb radially outward directed forces. This makes it possible to provide on the profiling roller relatively high radial feed forces in the outward direction in order to bring about an efficient non-cutting forming of the internal profile. In this, the counter-pressure roller ensures a smooth circulation of the workpiece.

Basically, it is possible that during the forming of the internal profile an external profile is also formed into the external side of the circumferential wall. According to the invention an efficient method variant resides in the fact that during the forming of the internal profile into the internal side an external side of the circumferential wall remains non-deformed.

By way of the method according to the invention various workpieces and products can basically be produced with an internal profile with longitudinal ribs. According to the invention it is particularly preferred that a hollow body with axial longitudinal ribs as internal profile is formed. According to the invention the hollow body is a gas or liquid tank, in which the axial longitudinal ribs serve for the reinforcement of the hollow body wall. In this way, a thin-walled yet highly stable hollow body can be formed in a non-cutting manner out of metal. The longitudinal ribs run axially, in particular they can be parallel to the longitudinal axis or provided with a certain deflection angle so that the longitudinal ribs can run in a spiral course.

The device according to the invention is characterized in that the at least one profiling roller can be moved into a cavity of the workpiece and fed to the internal side of the drum-shaped circumferential wall, wherein an internal profile with longitudinal ribs can be formed in a non-cutting manner into an internal side of the circumferential wall.

By way of a forming device the previously described method according to the invention can be carried out in particular so that the corresponding advantages result therefrom. The profiling roller is rotatably supported on a corresponding roller support and via an axial adjustment drive it can be moved axially into the cavity of the drum- or cup-shaped workpiece. Through an appropriate radial feed force the profiling roller rolls off on the internal side of the drum-shaped circumferential wall of the workpiece, whereby the internal profile with longitudinal ribs is formed in a non-cutting manner. In this way, a wide variety of internal profiles with longitudinal ribs can be produced efficiently with the device.

According to a preferred embodiment of the device it is of advantage that at least two profiling rollers are provided, the positions and feed movements of which can be coordinated so that a uniform internal profile can be formed on the internal side of the workpiece. In particular, more than two profiling rollers can be evenly arranged along the internal circumference of the workpiece. Through this, the transverse forces acting on the workpiece can compensate each other. The rollers are dimensioned and arranged such that they mesh uniformly with the formed internal profile. For the synchronization of the profiling rollers with the workpiece the profiling rollers can each have a roller drive of their own. By preference, via a control the roller drive can be coordinated and synchronized with the main spindle drive in order to drive the workpiece in a rotating manner.

Another advantageous embodiment of the invention resides in the fact that to each internal profiling roller an external counter-pressure roller is assigned which can be fed radially opposite the profiling roller to an external side of the workpiece. The external counter-pressure roller can be smooth-surfaced or can be provided with an external profile itself. The counter-pressure roller serves as a kind of counter bearing to absorb the radial deflective forces in order to thereby ensure a smooth circulation of the workpiece.

The invention is set out further hereinafter by way of a preferred embodiment illustrated schematically in FIG. 1.

FIG. 1 shows a partial cross-sectional view in a highly schematic manner through the part of a device 10 during the forming of a workpiece 1 with a drum-shaped circumferential wall 2.

A profiling roller 12 with an external profile 14 is fed radially to an internal side 3 of the workpiece 1 while the said workpiece 1 is set into rotation in the direction of the arrow. Due to the radial feeding the circumferential wall 2 of the workpiece 1 is deformed in a non-cutting manner, whereby an internal profile 5 is designed according to the profile 14 of the co-rotating profiling roller 12. The internal profile 5 has axially running longitudinal ribs 6.

Radially opposite the profiling roller 12 a smooth-surfaced counter-pressure roller 16 is applied to an external side 4 of the workpiece 1. The co-rotating counter-pressure roller 16 ensures that the external side 4 of the circumferential wall 2 of the workpiece 1 remains non-deformed, whereby a smooth circulation of the rotating workpiece 1 is secured.

Figure 2:
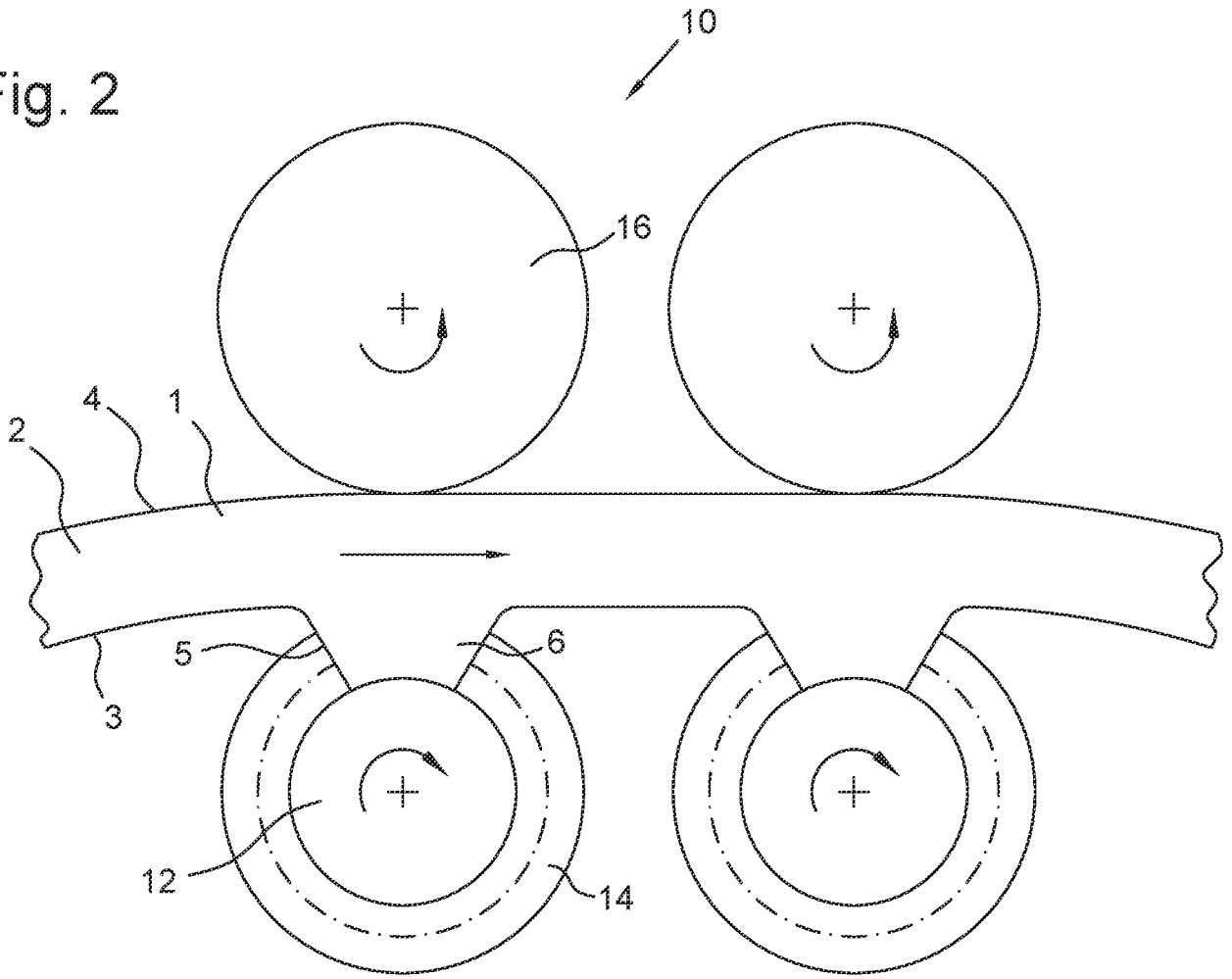

FIG. 2 shows another preferred embodiment of the present disclosure in which device 10 includes a plurality of profiling rollers 12, each having a respective external profile 14. A respective counter-pressure roller 16 is applied to an external side 4 of workpiece 1 in a direction that is radially opposite to one of the profiling rollers 12. As in the embodiment shown in FIG. 1, the workpiece 1 is deformed in a non-cutting manner to form an internal profile 5 according to the profile 14 of the plurality of profiling rollers 12.

The invention claimed is:

1. A method for producing a hollow body having a drum-shaped circumferential wall, comprising: feeding the circumferential wall of the hollow body through at least one pair of rollers to form an internal profile on the circumferential wall, the at least one pair of rollers including a rotatably-supported internal profiling roller and a corresponding rotatably-supported external counter-pressure roller, wherein the at least one internal profiling roller circulates along a first surface on an internal side of the circumferential wall while applying pressure to the first surface to form the internal profile, the at least one external counter-pressure roller maintains direct contact with a second surface of the circumferential wall that is opposite to the internal side of the circumferential wall, and the at least one external counter-pressure roller rotates in a direction opposite to that of the internal profiling roller, such that the internal profile is formed on the circumferential wall in a non-cutting manner, and the internal profile is configured to reinforce the circumferential wall of the hollow body by forming a plurality of longitudinal ribs on the workpiece, each of the longitudinal ribs having a longest extent that extends along an axial direction of the circumferential wall; the at least one pair of rollers constitutes a plurality of pairs of rollers through which the workpiece is fed; the plurality of pairs of rollers comprising a plurality of roller drives, wherein each internal profiling rollers among the plurality of pairs of rollers is provided with a respective roller drive among the plurality of roller drives.

2. The method according to claim 1, wherein the at least one profiling roller is fed axially and/or radially.

3. The method according to claim 1, wherein a profiling is exclusively carried out on the internal side of the circumferential wall.

4. The method according to claim 1, wherein during the forming of the internal profile into the internal side, an external side of the circumferential wall remains non-deformed.

5. The method according to claim 1, wherein as internal profile a toothed profile is formed.

6. The method according to claim 1, wherein in feeding the circumferential wall of the hollow body through the at least one pair of rollers, the circumferential wall is held fixed and the at least one pair of rollers move along the extent of the circumferential wall.

7. The method according to claim 1, wherein in feeding the circumferential wall of the hollow body through the at least one pair of rollers, each of the at least one pair of rollers is held fixed and the circumferential wall moves through each of the at least one pair of rollers.

8. The method according to claim 1, wherein the at least one external counter-pressure roller forms an external profile in the circumferential wall.

* * * * *